United States Patent [19]

Redding

[11] 4,303,043

[45] Dec. 1, 1981

[54] SLUDGE COLLECTION SYSTEM FOR A NUCLEAR STEAM GENERATOR

[75] Inventor: Arnold H. Redding, Murrysville, Pa.

[73] Assignee: Westinghouse Electric Corp., Pittsburgh, Pa.

[21] Appl. No.: 60,512

[22] Filed: Jul. 25, 1979

[51] Int. Cl.[3] ..... F22B 37/54

[52] U.S. Cl. ..... 122/382; 122/32; 122/34

[58] Field of Search ..... 122/32, 34, 381, 382, 122/492; 165/113, 114, 119

[56] References Cited

U.S. PATENT DOCUMENTS

| | | | |
|---|---|---|---|
| 3,227,142 | 1/1966 | Bell et al. | 122/34 |
| 3,804,069 | 4/1974 | Bennett | 122/34 |
| 3,906,905 | 9/1975 | Andrieu et al. | 122/32 |
| 3,916,844 | 11/1975 | Cassell | 122/32 |
| 3,924,575 | 12/1975 | Zipay | 122/34 |

*Primary Examiner*—Edward G. Favors

*Attorney, Agent, or Firm*—E. F. Possessky

[57] ABSTRACT

Removal of concentrated suspended particulate material from the recirculating carry-over water in a nuclear steam generator is provided by establishing a mud drum or reservoir of relatively quiescent water, permitting the concentrated solids contained therein to settle out prior to returning the water for mixing with the feedwater. Baffles in the mud drum intercept the entering carry-over water in a manner such that only a small portion of it is exchanged by the newly entering water so that, for the most part, there is sufficient residence time in a relatively quiescent environment to settle out the solids.

5 Claims, 1 Drawing Figure

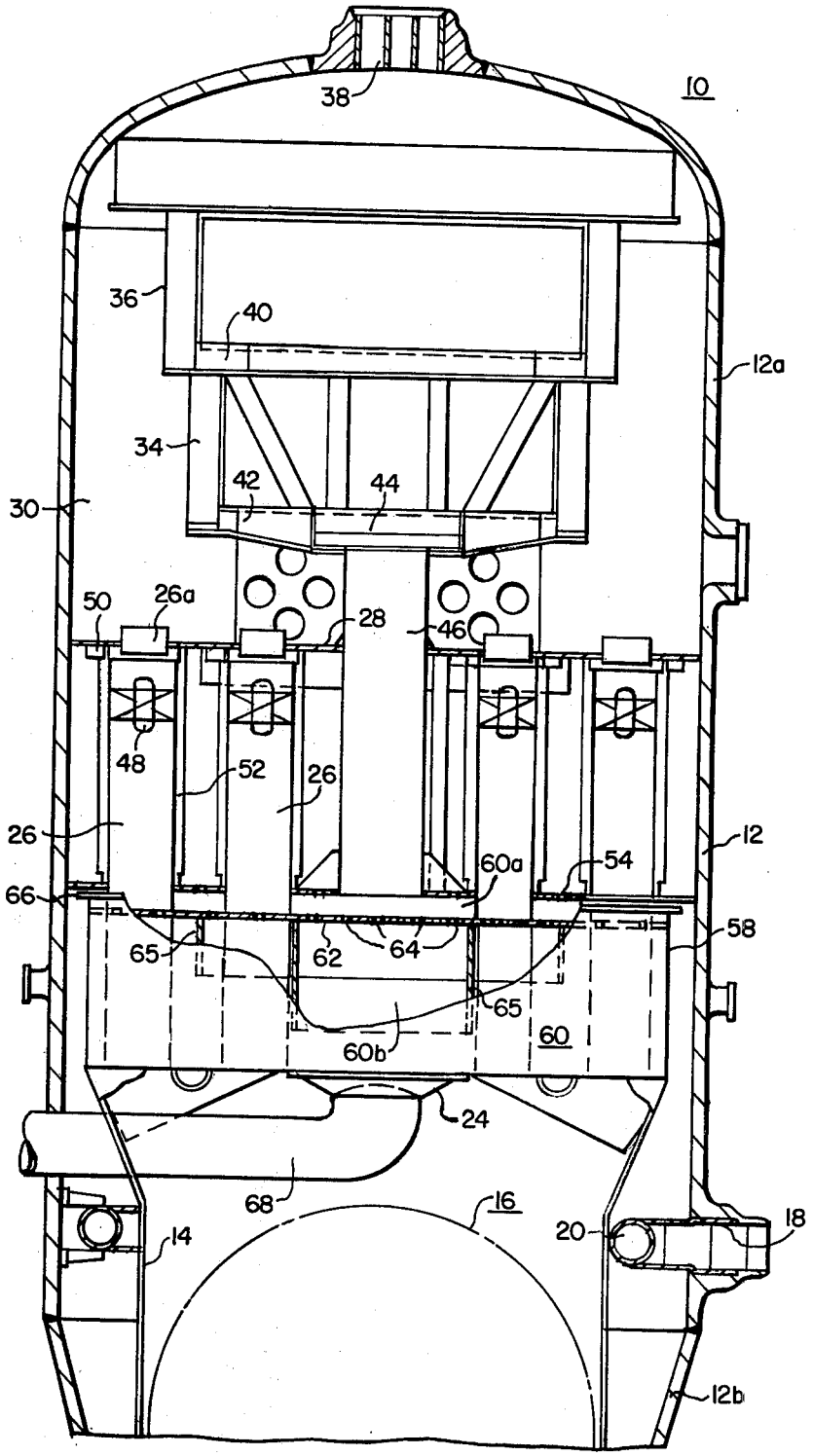
10
38
36
40
12a
34
42
44
30
50
26a
28
46
48
52
26
26
12
60a
54
66
58
65
62
64
65
60b
60
24
68
16
14
20
18
12b

SLUDGE COLLECTION SYSTEM FOR A NUCLEAR STEAM GENERATOR

BACKGROUND OF THE INVENTION

1. Field of the Invention

This invention relates generally to a nuclear steam generator, and more particularly to a mud drum for collecting the concentrated solids from the recirculating carry-over water within the generator.

2. Description of the Prior Art:

It is well known in the art of steam generators to have certain spaces or volumes therein of relatively low velocity fluid flow to give the solids suspended in the fluid an opportunity to settle out in an area where they can be relatively easily collected and eliminated from the generator.

One example of such structure in a shell and tube type vapor or steam generator is shown in U.S. Pat. No. 3,916,844, wherein the feedwater, upon entering the shell, is received in a settling chamber of low liquid velocity. However, this settling chamber intercepts the incoming feedwater which does not have a very high concentration of suspended solids per unit volume (although it also receives returning carry-over water which has a much higher concentration of suspended particles, but which becomes considerably diluted upon mixing with the incoming feedwater within the chamber). Consequently, to be effective, a very large volume of low velocity feedwater is necessary for effective removal of the suspended solids.

SUMMARY OF THE PRESENT INVENTION

The present invention provides a settling chamber or sludge collection chamber in a steam generator, of a type commercially available from the corporate assignee of the present invention, which is interposed between the recirculating carry-over water and the incoming feedwater, to intercept the recirculating water and retain at least a portion thereof in a substantially stagnant condition to permit the highly concentrated entrained solids to be deposited within the chamber. Baffle means are provided to limit the exchange of the continuously incoming carry-over water with the water already retained in the chamber to minimize turbulence, yet permit some rate of exchange between the incoming recirculating water and the water in the chamber from which the sediments have already been removed.

BRIEF DESCRIPTION OF THE DRAWING

FIG. 1 is an elevational cross-sectional view of the upper portion of a steam generator.

DESCRIPTION OF THE PREFERRED EMBODIMENT

A vertical U-tube steam generator of the type generally referred to herein is more fully described in commonly owned U.S. Pat. No. 4,079,701, which is herein incorporated by reference for the general description of a nuclear steam generator. Thus, reference is made to FIG. 1 for the particular location, within such a steam generator, of the mud drum or sludge collection chamber of the present invention. As therein seen, the steam generator 10 has an outer generally cylindrical shell 12 (the upper portion 12*a* and a transition portion 12*b* being shown) enclosing in annular spaced relationship a cylindrical inner wrapper 14 which in turn encloses the U-tube bundle 16. A feedwater inlet 18 to an annular feedwater discharge tube 20 is disposed in the annular space between the shell 12 and the wrapper 14 and provides feedwater which, as explained in the referenced patent, flows into heat exchange relationship with the tube bundle 16, whereupon the feedwater is changed to steam.

The upper end of the wrapper is closed by a generally horizontal plate 22 having a centrally dished configuration as at 24.

The steam generated within the wrapper 14 along with the recirculating water flows upwardly through a plurality of primary vapor separators 26 extending vertically from the plate 22 and in vapor flow communication with the wrapper interior. The upper end of the separators 26 pass through and are supported in an upper plate member 28 for discharging the steam into an upper chamber 30 in the shell 12, and the separators 26 are further supported by an intermediate horizontal support plate 32.

A pair of vertically stacked chevron moisture separators 34, 36 are supported in the chamber 30 in series flow relationship with the primary vapor separator outlet nozzle 26*a*, such that steam within the chamber 30 must pass through the separators prior to being discharged from the generator through outlet port 38. The water separated from the vapor by the chevron separators 34, 36 is collected in the peripheral collection troughs 40, 42, framing the separators and is eventually directed to a collection pan 44 which in turn is centrally drained into a central vertical drain pipe 46 extending therefrom, through the upper plate 28 and intermediate support plate 32 to terminate subadjacent to the intermediate support plate 32.

Vapor separating swirl vanes 48 are disposed within each primary vapor separator 26 adjacent to discharge end 26*a* to initially separate the entrained water from the vapor passing therethrough. The separated water is centrifuged outwardly into tangential nozzles 50 or annular water downcomers 52, both of which discharge the water onto the upper surface of the intermediate support plate 32. This intermediate support plate has a plurality of openings 54 for gravity drain of the separated water therefrom.

A smaller drainpipe 56 extends from an opening in the upper support plate 28 to subadjacent the lower support plate 32 to drain water separated from the vapor in the chamber 30 and collected on the upper plate 28.

Thus, as is seen, all water condensed or separated from the vapor discharged from the wrapper 14 is eventually collected and directed back to the top plate 62 of the wrapper. A vertical cylindrical wall 58 extends upwardly from the peripheral edge of the plate 22 to subadjacent the intermediate support plate 32, forming a collecting chamber 60 into which all such water separated from the steam flow is eventually drained.

A horizontal plate or baffle member 62 generally coterminous with the sidewall 58 divides the chamber 60 into an upper portion 60*a* and a lower portion 60*b*. The baffle member 62 contains a plurality of apertures 64 for fluid flow or exchange between the two chambers 60*a*, 60*b*. Part of the flow penetrates the baffle 62 in its central portion, flowing downward into chamber 60*b*. This flow is in a generally radial direction, passing up through apertures in baffle 62 near its periphery, and back into chamber 60*a*. This water along with the flow which had not penetrated baffle 62 falls over the peripheral lip 66 and into the annular feed chamber to be mixed with the feedwater and recycled through the tube bundle 16.

The apertures 64 in baffle 62 are sized so that the flow through them will have only a low level of small scale turbulence that will dissipate rapidly, so that the flow in chamber **60*b* is largely quiescent. Further baffles 65 depending into chamber 60*b* from baffle 62 provide pockets or areas of generally stagnant flow increasing the opportunity for solids to settle out so that the maximum amount of sludge is deposited on the upper surface of plate 22**.

A blowdown pipe 68 extends from the dished portion 24 of the upper plate 22 to exteriorly of the outer shell 12 to permit occasional or continuous discharge of the collected solids therefrom.

This arrangement thus provides a collection chamber for receiving the separated liquid entrained in the steam as the liquid leaves the tube bundle. Such liquid, by virtue of the evaporation in the tube bundle, contains a relatively concentrated proportion of solids and therefore a large amount of solid materials can be settled out of this liquid in a much smaller receiving chamber than if a like amount were to be separated from the feedwater where the concentration of such solids is much less.

What is claimed is:

1. A sludge removal system for a vertically oriented nuclear steam generator wherein the vapors produced in the steam generator pass through means for separating entrained liquid from the vapor prior to the vapor being discharged from the generator, means including an upwardly open chamber for collecting the separated liquid prior to the liquid being returned to be mixed with the feedwater entering the generator, said chamber further including a generally horizontal baffle member separating the chamber into an upper and lower portion and having apertures therein for fluid flow therebetween for maintaining at least the liquid in the lower portion in a generally quiescent state to permit the solids within the liquid to settle therefrom, said liquid being discharged from said chamber by overflowing said upper portion and flowing therefrom into said feedwater and means for discharging the sludge collected in the lower portion from said steam generator.

2. Structure according to claim 1 wherein said horizontal baffle comprises a plate in the upper portion of said chamber and below the discharge of the liquid from the vapor separator means into said chamber.

3. Structure according to claim 2 wherein said lower chamber includes second baffle means therein for further slowing the flow of liquid through said chamber.

4. Structure according to claim 3 wherein a portion of the liquid entering the upper chamber flows through said apertures into said lower chamber portion and liquid in said last-named chamber flows upwardly through other of said apertures into said upper portion for discharge therefrom by overflowing the peripheral lip of said chamber to establish an exchange of fluid into the lower portion for settling of sludge therefrom.

5. Structure according to claim 4 wherein said means for discharging the collected sludge includes a blowdown pipe from a concave area of the bottom of said chamber to exteriorly of said generator.

* * * * *